US010337296B2

(12) United States Patent
Scull

(10) Patent No.: US 10,337,296 B2
(45) Date of Patent: Jul. 2, 2019

(54) GAS LIFT ASSEMBLY

(71) Applicant: The Southern Ute Indian Tribe, Ignacio, CO (US)

(72) Inventor: Michael Scull, Hot Springs Village, AR (US)

(73) Assignee: Red Willow Production Company, Ignacio, CO (US)

( * ) Notice: Subject to any disclaimer, the term of this patent is extended or adjusted under 35 U.S.C. 154(b) by 590 days.

(21) Appl. No.: 14/513,832

(22) Filed: Oct. 14, 2014

(65) Prior Publication Data

US 2015/0027691 A1 Jan. 29, 2015

(51) Int. Cl.
*E21B 43/12* (2006.01)
*E21B 43/00* (2006.01)

(52) U.S. Cl.
CPC ..... *E21B 43/006* (2013.01); *E21B 43/122* (2013.01)

(58) Field of Classification Search
CPC .... E21B 43/006; E21B 43/121; E21B 43/122; E21B 43/123; E21B 43/124; E21B 43/129; F04F 1/18; F04F 1/20
USPC ..... 417/108, 110
See application file for complete search history.

(56) References Cited

U.S. PATENT DOCUMENTS 1,195,915 A 8/1916 Damrow
1,782,310 A 11/1930 Overstreet
2,183,623 A 12/1939 Ross
2,631,774 A 3/1953 Plummer, Jr.
3,182,726 A 5/1965 Stone
3,268,004 A 8/1966 Kiel
3,887,008 A 6/1975 Canfield
4,394,883 A * 7/1983 Briscoe ..... E21B 31/107 175/304
4,545,731 A 10/1985 Canalizo et al.
4,708,595 A 11/1987 Maloney et al.
4,744,730 A * 5/1988 Roeder ..... E21B 43/124 417/172
4,807,814 A 2/1989 Douche et al.
5,022,427 A 6/1991 Churchman et al.
5,055,002 A * 10/1991 Roeder ..... E21B 23/02 417/172
5,083,609 A 1/1992 Coleman
5,113,939 A 5/1992 Ross et al.
5,372,190 A 12/1994 Coleman
5,875,852 A 3/1999 Floyd et al.
6,026,904 A * 2/2000 Burd ..... E21B 3/124 166/105
6,082,452 A 7/2000 Shaw et al.
6,357,530 B1 * 3/2002 Kennedy ..... E21B 43/124 166/105.6

(Continued)

*Primary Examiner* — Giovanna C Wright
*Assistant Examiner* — Ronald R Runyan

(57) ABSTRACT

An apparatus has an elongate body defining an interior chamber and a gas passage in communication with the interior chamber. The elongate body further includes a base defining a liquid opening and a cap defining an outlet opening. The liquid opening is adapted to receive a liquid disposed in a wellbore. The gas passage is adapted to receive a gas. An outlet of the gas passage is disposed a first distance from the base and an inner conduit is disposed in the interior chamber. The inner conduit includes a first open end in communication with the liquid opening and a second open end in communication with the interior chamber. The second open end is disposed a second distance from the base.

22 Claims, 8 Drawing Sheets

(56) References Cited

U.S. PATENT DOCUMENTS

| | | | | |
|---|---|---|---|---|
| 6,382,321 | B1 * | 5/2002 | Bates | E21B 43/124 166/105 |
| 6,705,403 | B2 * | 3/2004 | Podio | E21B 43/122 166/105 |
| 7,073,597 | B2 * | 7/2006 | Williams | E21B 17/18 166/105 |
| 8,302,695 | B2 | 11/2012 | Simpson et al. | |
| 2003/0024704 | A1 | 2/2003 | Hirsch et al. | |
| 2006/0076140 | A1 | 4/2006 | Rouen | |
| 2010/0101798 | A1 | 4/2010 | Simpson et al. | |

* cited by examiner

GAS LIFT ASSEMBLY

BACKGROUND

Downhole wellbores are utilized to extract methane gas from coal beds below ground. The amount of methane extracted can be increased by reducing the pressure on the coal bed. Typically, this is accomplished by removing water from above the beds. This reduces the pressure and thereby increases the rate at which methane is emitted from the coal. Water may be removed in a number of ways. De-watering pumps may be inserted into the wellbore and the water may be pumped out directly; however, traditional methods reach mechanical limits as the pressures decline. Alternatively, gas such as methane gas may be pumped into the wellbore, where it mixes with the water, to produce a mist or vapor that is then extracted from the wellbore.

GAS LIFT ASSEMBLY AND METHODS

The systems and methods described herein may be utilized in wells that typically have been inaccessible to traditional gas lift methods. Such gas lift methods typically require excessive back pressures (and therefore casing packer completion) on the reservoir to operate properly. Indeed, even low water levels in a well bore can exert sufficient hydrostatic head to prevent gas flow. The systems and methods described herein can extract product gas from well with very low pressures at the well reservoir face.

Additionally, the systems and methods described herein can also be utilized in existing rod well pump applications with minimal modifications to the well. For example, the rods and pump can be removed from the well. Thereafter, the inner string, seal assembly, tool, and other components, can be inserted into the outer string and set in the seating nipple previously occupied by the rod pump. This seals the two strings and the reservoir to properly control gas flow. The configuration allows for a reduction in hydrostatic head and still enables lifting of water, in a mist form, to the surface. Use of the choke helps prevent excessive head in the inner string, and thus, prevents water from entering the tool.

In one aspect, the technology relates to an apparatus having an elongate body defining an interior chamber and a gas passage in communication with the interior chamber, the elongate body further includes a base defining a liquid opening and a cap defining an outlet opening, wherein the liquid opening is adapted to receive a liquid disposed in a wellbore, and wherein the gas passage is adapted to receive a gas, wherein an outlet of the gas passage is disposed a first distance from the base; and an inner conduit disposed in the interior chamber, and wherein the inner conduit includes: a first open end in communication with the liquid opening; and a second open end in communication with the interior chamber, wherein the second open end is disposed a second distance from the base.

In another aspect, the technology relates to an apparatus which includes an elongate body defining an interior chamber, a liquid inlet, a gas inlet in communication with the interior chamber, and a liquid-gas outlet in communication with the interior chamber; and an inner conduit disposed within the elongate body and in communication with liquid inlet, wherein the inner conduit defines a liquid outlet in communication with the interior chamber, and wherein the gas inlet is disposed a first distance from the liquid inlet and wherein the liquid outlet is disposed a second distance from the liquid inlet, wherein the second distance is greater than the first distance.

In yet another aspect, the technology relates to a method which includes pressurizing, with a working gas, an outer string of a downhole wellbore so as to expel water from the outer string; pressurizing, with the working gas, an inner string of a downhole wellbore so as to expel water from the inner string and a tool disposed therein; reducing pressure in the inner string, wherein reducing pressure in the inner string allows water to enter the tool from an inlet; causing the working gas to flow from the outer string through the tool, wherein the flow of working gas and water, in combination, produce an upward flow of mist in the inner string; and collecting the mist from the inner string.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

The same number represents the same element or same type of element in all drawings.

DETAILED DESCRIPTION

The present disclosure is directed generally to systems and methods that are utilized to extract methane gas product from a downhole wellbore. In general, an extraction tool is inserted into a wellbore and pressurized with a compressed working gas, to remove water present in the wellbore. The water is then entrained within the compressed working gas being injected around the tool. This entrainment produces a vapor, mist, or other generally lighter mixture of water and working gas that allows the water to be extracted from the wellbore. The tool allows the water table to drawn down to and maintained at the lowest reservoir level, thereby reducing the pressure on the coal bed and increasing the rate at which the coal bed generates gas.

Certain terminology used herein describes the relative relationships between pressures, flow rates, etc., as well as the states of the various fluids that are moved through the wellbore and tool. For example, use of the term "high pressure" in one portion of the wellbore does not necessarily mean that the pressure in that portion is at a certain measured threshold in excess of ambient. Instead, use of the term is meant to describe a condition where the pressure in one portion of the wellbore is higher than a pressure in another portion of the wellbore. In another example, the term "mist" or "vapor" is used to describe a mixture of water and working gas that is extracted from the wellbore utilizing the tools described herein. These terms are used for convenience to describe a condition where water is entrained within a working gas being injected upwards into the extraction tool and implies a state where a plurality of discrete, small volumes of water are separated from each other by a volume of working gas, such that the water can be lifted or otherwise extracted out of the wellbore by the pressure of the working gas. It is not necessarily utilized to mean a change in state of the water due to temperatures, pressure, or molecular changes, although such definitions are not excluded from the terms "mist" or "vapor" or similar terms used herein.

Figure 1A:
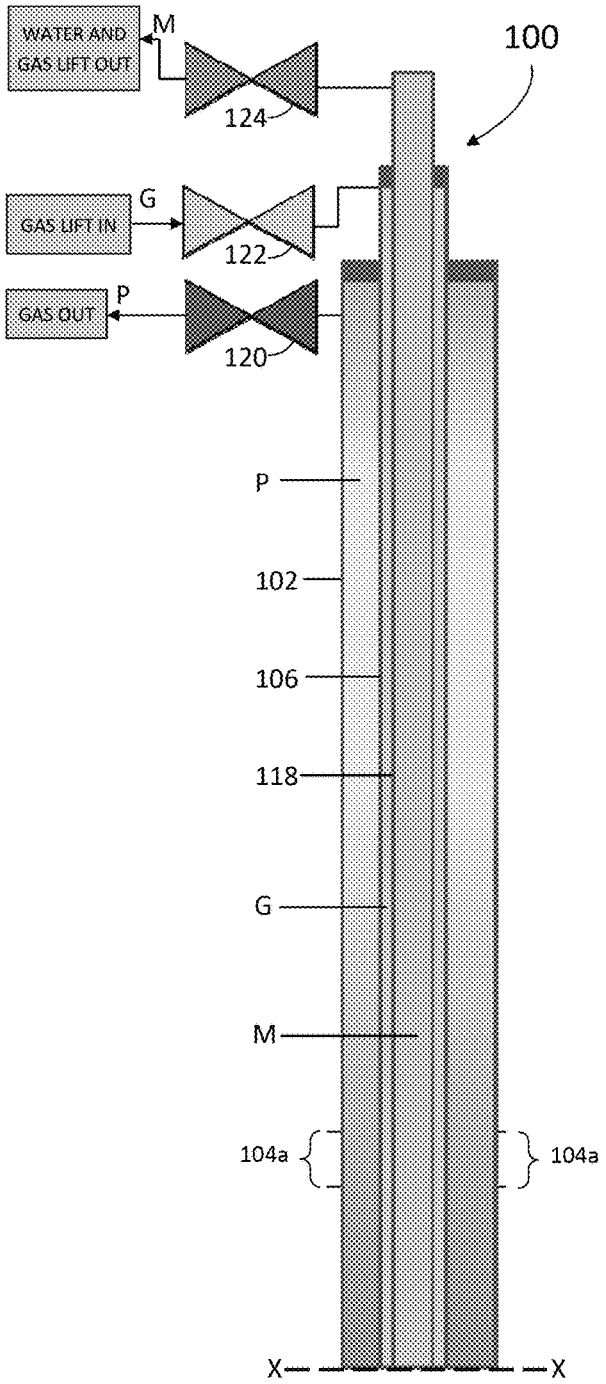
FIGS. 1A and 1B depict a schematic side sectional view of a wellbore.
Figure 1B:
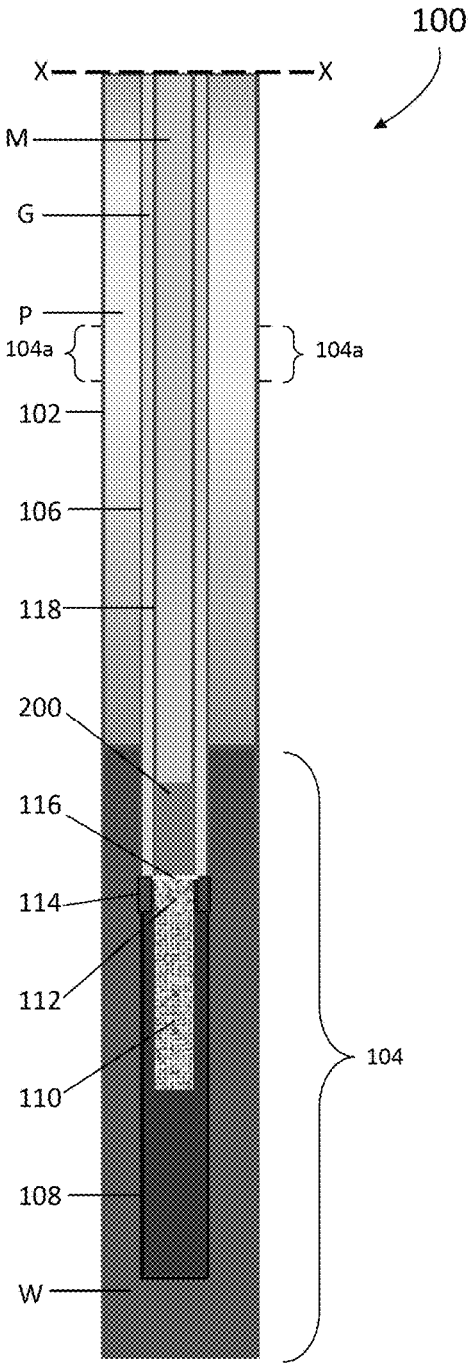

FIGS. 1A and 1B depict a schematic side sectional view of a wellbore 100. FIG. 1A depicts an upper portion of the wellbore 100, while FIG. 1B depicts a lower portion thereof. The upper and lower portions are joined at line X-X, and can be any desired or required length. These two figures are described simultaneously. The wellbore 100 is drilled and lined with a casing 102. A lower portion 104 of the casing 102 is perforated or screened so as to allow introduction of water W and natural gas into an interior of the casing 102. An outer pipe or conduit, often referred to as an outer string 106 is inserted into the casing 102. A number of components are fixed to a bottom portion of the outer string 106 such that they extend into the water W below the casing perforations. These include a perforated or otherwise open tailpipe 108 to allow passage of the water W, as does a seating nipple 114 that is disposed in the outer string 106. In certain embodiments, the seating nipple 104 can be disposed in the outer string 106 approximately 30 feet above the end thereof. A screen 110 used to filter the water W during extraction operations and seal assembly 112 are secured to an inner pipe or conduit, referred to as an inner string 118, is inserted into the outer string 106. A no-go 116 is disposed about the inner string 118 and rests on the seating nipple 114 so as to prevent the inner string 118 from dropping further into the outer string 106. A gas injection tool 200 (embodiments of which are described below) can be integral with, or inserted into, the inner string 118.

A number of valved conduits are connected to the various internal volumes of the wellbore 100. For example, a product valve 120 controls removal of a product P, such as methane gas, from an interior of the casing 102. A working gas valve 122 controls the injection of a working gas G into the outer string 106. An isolation valve 124 controls extraction of a mist M (formed of the working gas G and the water W) from the inner string 118. Of course, other components may be installed on the various lines proximate the various valves 120, 122, 124 so as to control and monitor the various flows therein. Such components can include, for example, pressure regulators, temperature, pressure, and flow sensors, automatic emergency shut-off valves, and so on, as known in the art. Methods of utilizing the working gas G so as to remove the mist M (containing the water W) are described herein.

Figure 2:
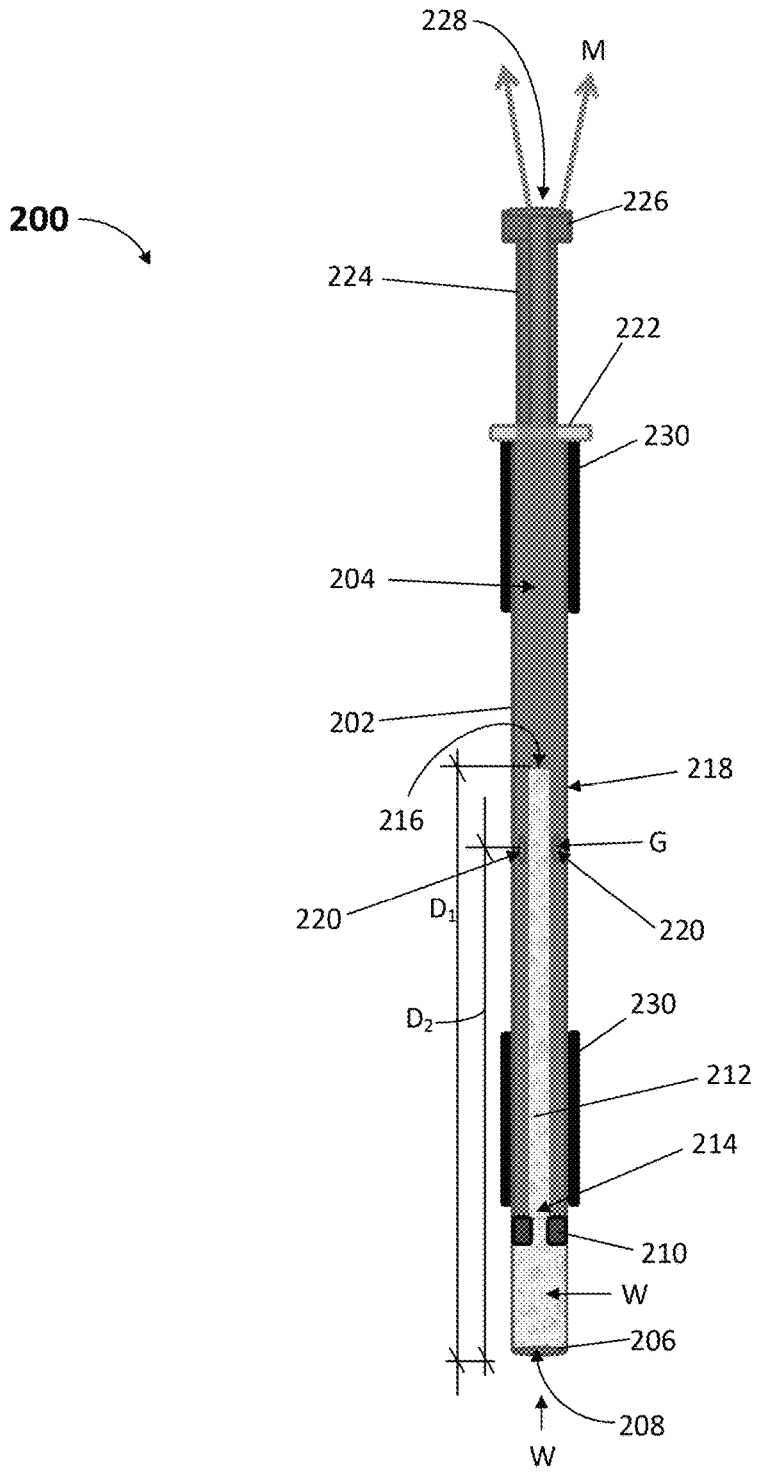
FIG. 2 depicts a schematic side sectional view of one embodiment of a gas lift assembly.

FIG. 2 depicts a schematic side sectional view of one embodiment of a gas lift assembly or tool 200. The tool 200 is a generally elongate device that includes an elongate body 202 defining an interior chamber 204. The body 202 includes a base 206 that defines a liquid inlet 208 for allowing entry of water W when the tool 200 is inserted into a wellbore. A choke 210 having a diameter less than that of the liquid inlet 208 may be disposed proximate thereto so as to limit the flow of water W into the tool 200. An inner conduit 212 is disposed within the elongate body 202 and defines a liquid inlet 214 and a liquid outlet 216. The liquid inlet 214 of the inner conduit 212 is in fluidic communication with the liquid inlet 208 defined by the base 206. The elongate body 202 may include an outer wall 218 that defines a gas passage or gas inlet 220 therethrough. Each of the liquid outlet 216 and the gas passage 220 are spaced from the liquid inlet 208 in the base 206. In the depicted embodiment, the liquid outlet 216 is disposed a distance $D_1$ from the base 206, while the gas passage 220 is disposed a distance $D_2$ from the base 206. In the depicted embodiment, the distance $D_2$ is less than the distance $D_1$. This helps ensure proper mixing of gas G and water W so as to form a mist M for extraction from the inner string 118. A no-go 222 connects the elongate body 202 to a cap 224. The cap 224 includes an enlarged head 226 that functions as a retrieval neck, such as a configuration often referred to as a fishing neck, which allows the tool 200 to be lowered into the inner string 118 with a wireline unit during operation, and later removed as required or desired. The cap 224 defines a mist outlet 228 through which the mist M of gas G and water W exits during extraction operations. The depicted tool 200 also includes one or more seal assemblies 230 that substantially surround the elongate body 202. The seal assemblies 230 allow for connection to one or more elements, not shown, that can aid in insertion of the tool 200 into the inner string 118.

Figure 3:
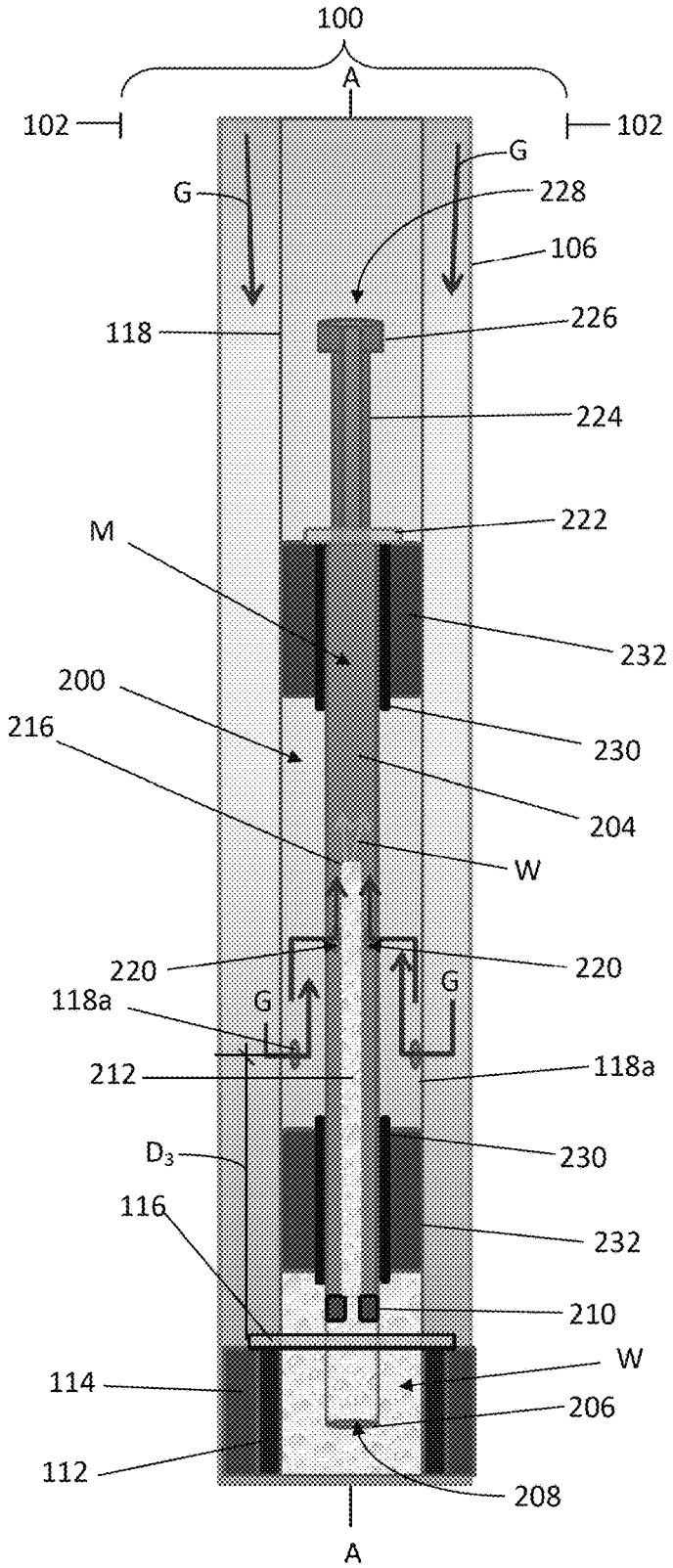
FIG. 3 depicts a schematic side sectional view of the gas lift assembly of FIG. 2 disposed in a wellbore.

FIG. 3 depicts a schematic side sectional view of the gas lift assembly 200 of FIG. 2 disposed in a wellbore 100. A casing 102, such as that described above in FIGS. 1A and 1B is not depicted in whole for clarity. Additional elements of the wellbore 100 are described above with regard to FIGS. 1A and 1B and are therefore not necessarily described further. A number of components of the tool 200 are described above with regard to FIG. 2 and are therefore not necessarily described further. The tool 200 is disposed within an inner string 118 that is, in turn, disposed within an outer string 106. The depicted tool 200 also includes two bore supports 232, which help maintain alignment of the elongate body 202 within the inner string 118 along an axis A. In certain embodiments, the surfaces of the bore supports 232 may be polished or otherwise smooth to provide pressure containment between the seal assemblies 230. The two bore supports 232 also create the chamber where gas can enter through the outer string to the tool 200 gaining access to the gas inlet 220. The tool 200 is lowered into the inner string 118 until a desired depth is achieved. The inner string 118 defines one or more string gas passages 118*a*, which allows passage of the working gas G from the outer string 106 into the inner string 118. Notably, the string gas passages 118*a* are disposed a distance $D_3$ from the no-go 116. With this known distance $D_3$, the tool 200 may be inserted such that the distance $D_3$ is less than both of distances $D_2$ and $D_1$, as described above. Thus, when working gas G is injected downward into the outer string 106, the direction of the gas G turns upwards as it enters the inner string 118 via the gas passages 118*a*. Once within the inner string 118, the working gas G travels upwards as it enters the elongate body 202 of the tool 200 through gas inlet 220. The gas G is still travelling upward as it makes contact with and mists the water W that is flowing out from the liquid outlet 216 of the inner conduit 212. By controlling the flow rate of gas, this upward flow of working gas G and water W efficiently mixes the gas G and water W such that a fine mist M is produced. This mist M is easily removed from the tool 200 via the mist outlet 228, thereby dewatering the well. Long term operation of the dewatering tool, then, allows the water table near the well to be lowered and maintained substantially at the depth of the tool.

Figure 4:
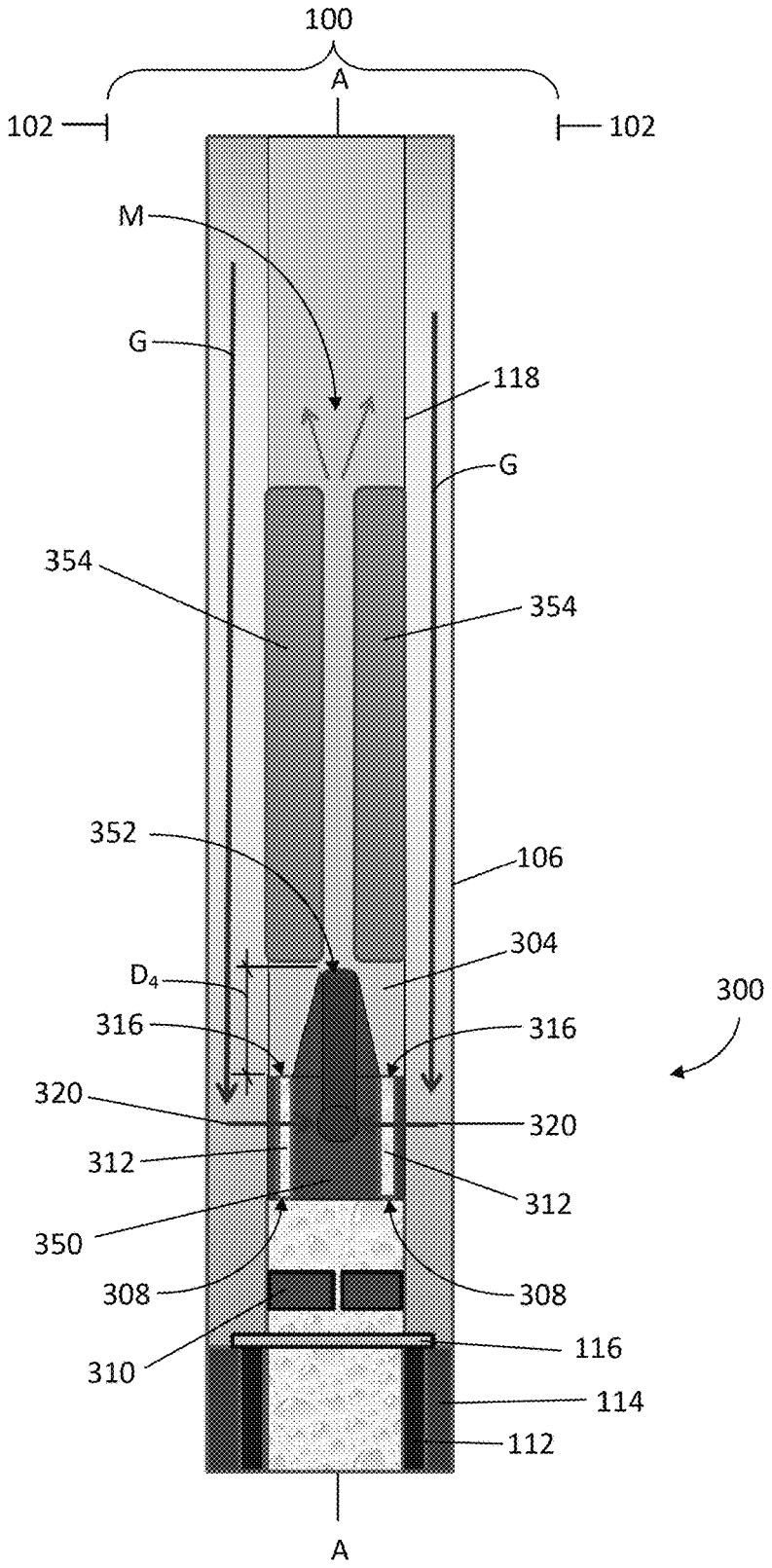
FIG. 4 depicts a schematic side sectional view of another embodiment of a gas lift assembly disposed in a wellbore.

FIG. 4 depicts a schematic side sectional view of another embodiment of a gas lift assembly 300 disposed in a wellbore 100. A number of the components of the wellbore 100 are described above and are therefore not necessarily described further. Certain components of the gas lift tool 300 are already described above with regard to the tool 200 depicted in FIG. 2. These components are numbered similarly to the components of FIG. 2 (e.g., choke 210, 310; interior chamber 204, 304; etc.) and are not necessarily described further. The tool 300 in this embodiment is integrated into the inner string 118 and may comprise a bottom-most portion of the inner string 118 that is inserted into the outer string 106. The tool 300 includes a manifold 350 that defines a plurality of passages, as described in more detail below. The manifold 350 may be secured in the inner string 118 above a choke 310. At least one gas passage or inlet 320 penetrates the manifold 350 and the inner string 118. Multiple gas passages 320 are joined within the manifold 350 so as to allow passage of a working gas G out of a single gas outlet 352 that is axially disposed within the manifold 350 and inner string 118. Water W enters one or more conduits 312 formed in the manifold 350 at a liquid inlet 308 and exits the conduits 312 at a liquid outlet 316. Here, a plurality of conduits 312 are formed about a circumference of the manifold 350, but other locations within the tool 300 are contemplated. In the depicted embodiment, the gas outlet 352 may be a distance $D_4$ above the liquid outlets 316. The water W and working gas G produce a mist M in the interior chamber 304 and may pass through a throat 354 having a reduced diameter, relative to the interior chamber 304. This mist M then is discharged from, drawn out of, or otherwise expelled from the inner string 118. Again, as with the embodiment of FIG. 3, changing the direction of the working gas G to an upward flow prior to mixing with the water W helps efficiently produce the mist M.

Figure 5:
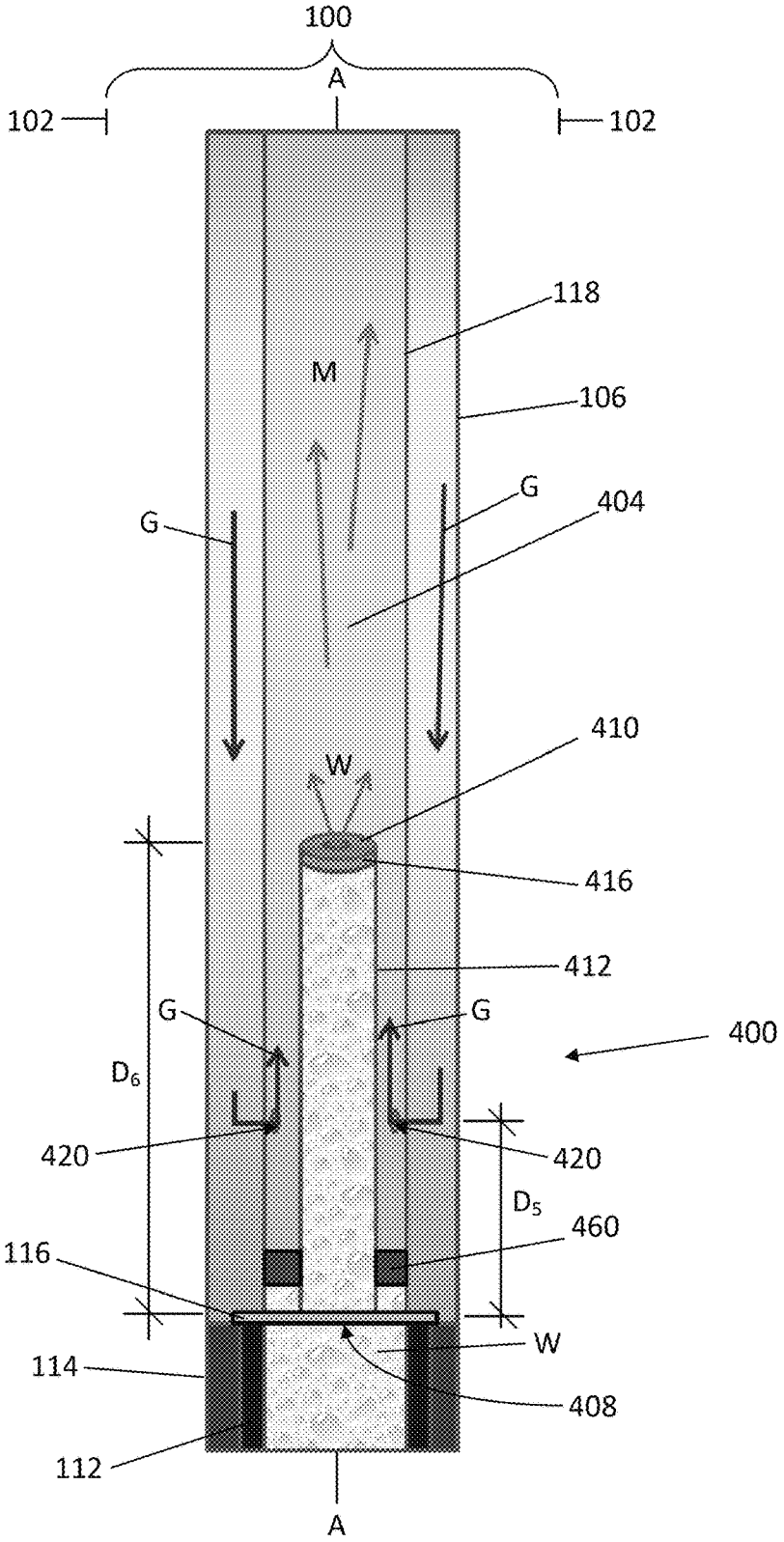
FIG. 5 depicts a schematic side sectional view of another embodiment of a gas lift assembly disposed in a wellbore.

FIG. 5 depicts a schematic side sectional view of another embodiment of a gas lift assembly 400 disposed in a wellbore 100. A number of the components of the wellbore 100 are described and are therefore not necessarily described further. Certain components of the gas lift tool 400 are already described above with regard to the tools depicted in FIGS. 2 and 3. These components are numbered similarly to the components of FIGS. 2 and 3 (e.g., choke 210, 310, 410; interior chamber 204, 304, 404; etc.) and are not necessarily described further. The tool 400 in this embodiment is integrated into the inner string 118 and may comprise a bottom-most portion of the inner string 118 that is inserted into the outer string 106. A support 460 holds the inner conduit 412 in place and may align the conduit 412 within the inner string 118 along axis A. A liquid inlet 408 of the inner conduit 412 allows water W to enter the conduit 412. One or more gas passages 420 penetrate the inner string 118 and are disposed a distance $D_5$ from the liquid inlet 408. As with other embodiments described herein, gas passages 420 change the downward flow of the working gas G into an upward flow as it enters the inner string 118. A choke 410 is disposed at an outlet 416 of the inner conduit 412 at a distance $D_6$ from the liquid inlet 408. The water W and gas G mix in an interior chamber 404 and form a mist M that is discharged from the inner string 118 at the top of the well.

Figure 6A:
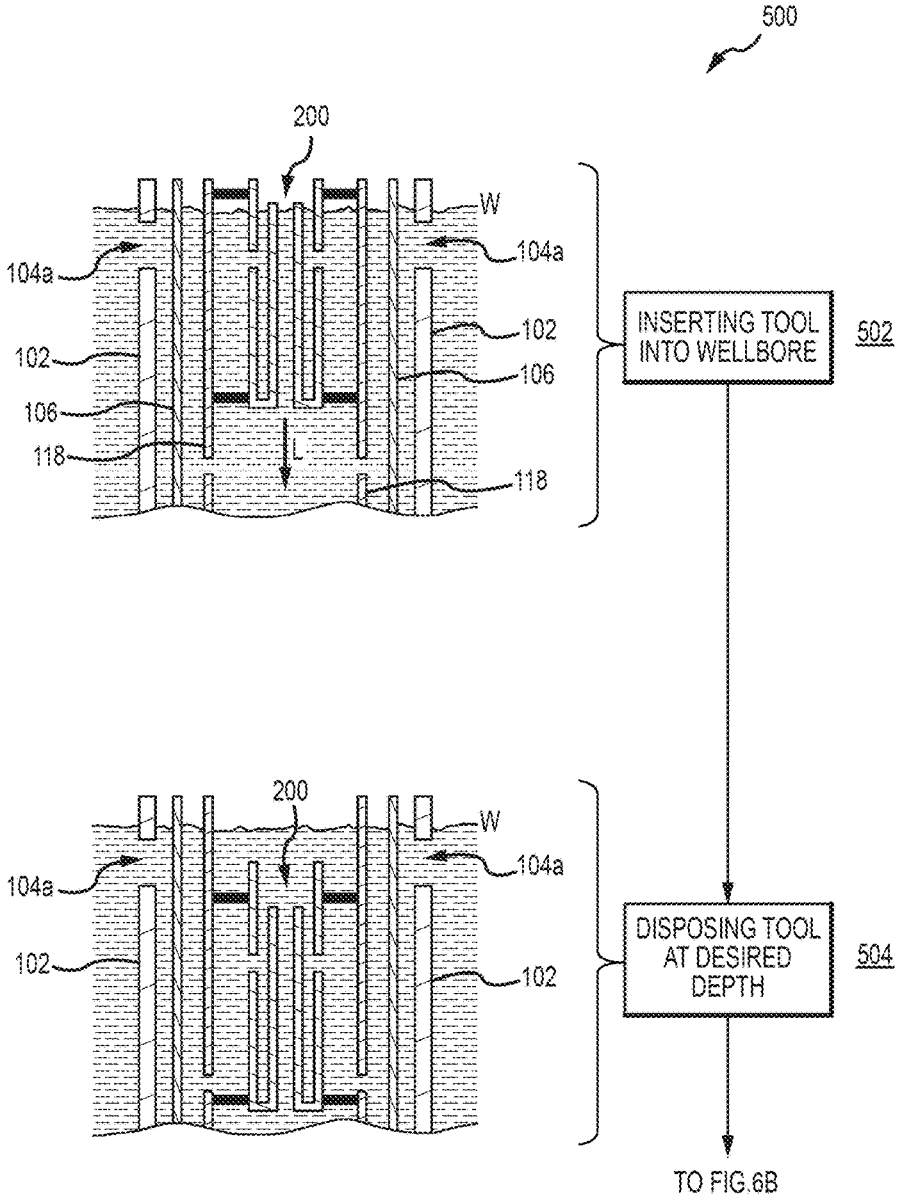
FIGS. 6A-6C depict a method of removing water from a downhole wellbore.
Figure 6B:
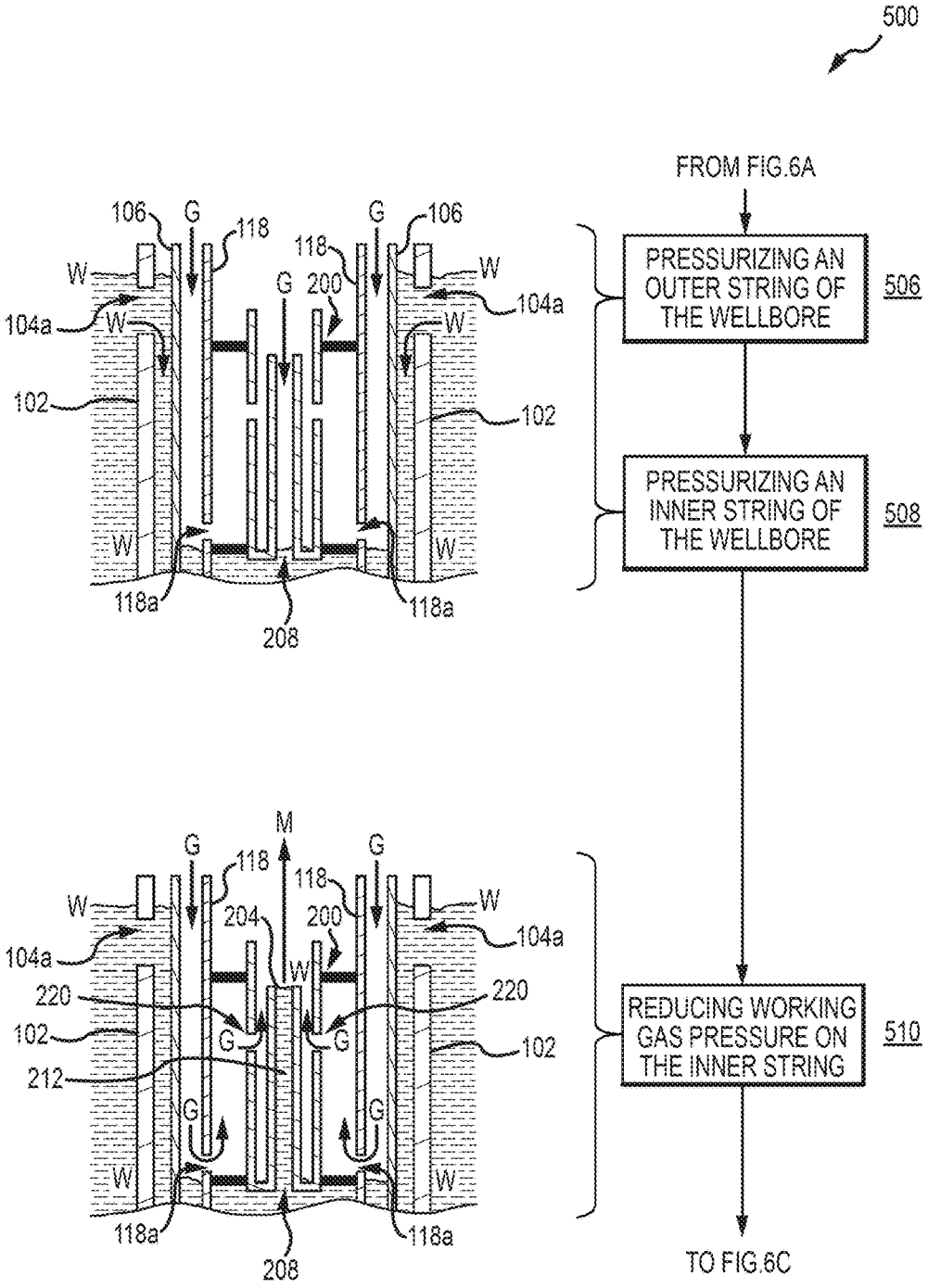
Figure 6C:
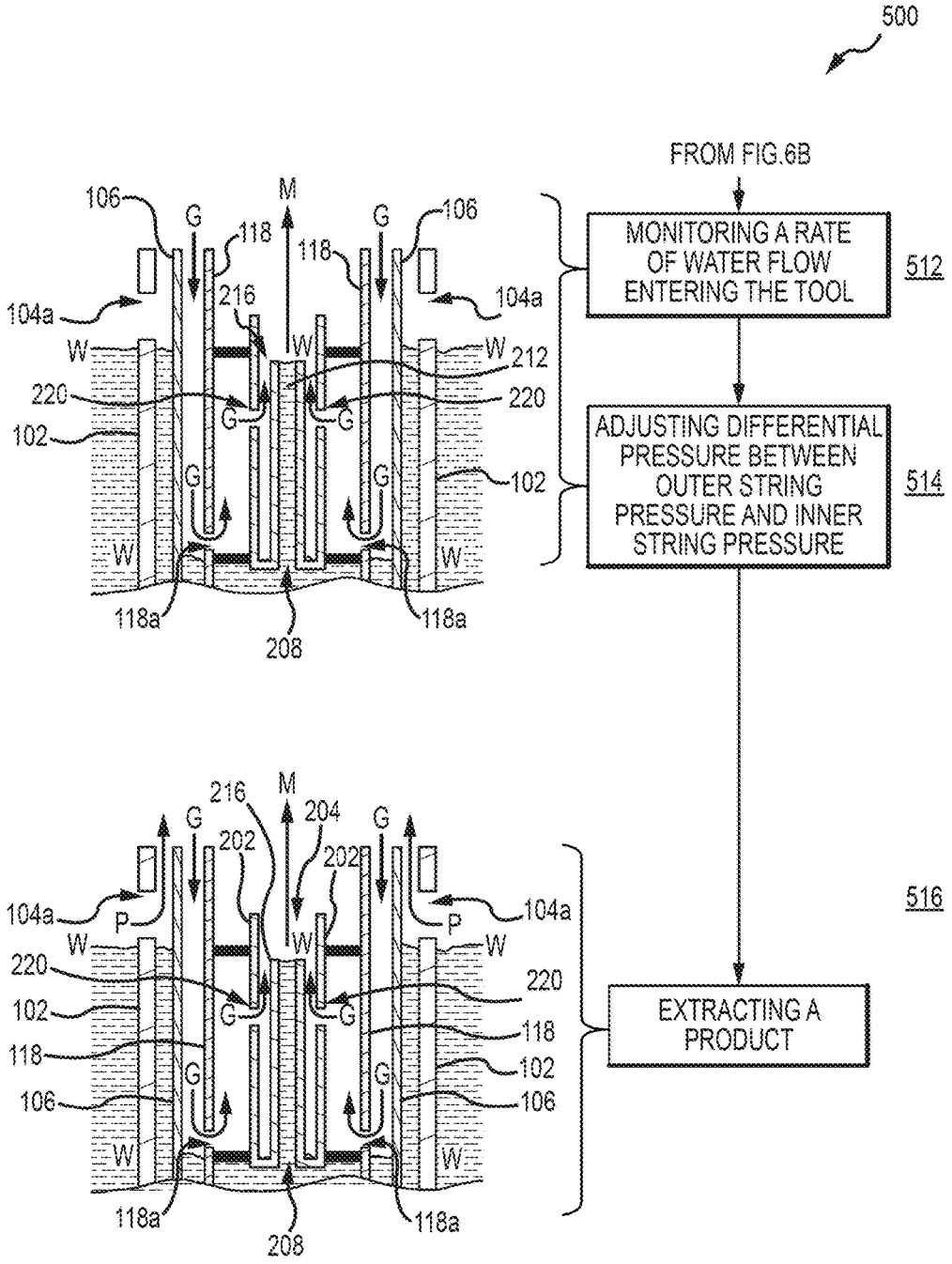

FIGS. 6A-6C depict a method 500 of removing water from a downhole wellbore 100. Although the method 500 (depicted on the right hand side of FIGS. 6A-6C) is depicted in parallel with a wellbore 100 configuration utilizing the tool 200 described above (depicted on the left hand side), a person of skill in the art would recognize the modifications required to utilize tool 300, tool 400, or other tool configurations, so as to perform the method 500. The method 500 begins with insertion of a tool 200 into the wellbore 100, defined by the casing 102, operation 502. In the depicted embodiment, the tool 200 is lowered L into the inner string 118, so as to be disposed below a level of water W in the wellbore 100. In other embodiments, the tool may be integral with the inner string 118, such that when the inner string 118 is inserted into the outer string 106, the tool is also inserted. As can be seen in the left-hand figure corresponding to operation 502, water W is disposed in the wellbore 100 and enters the casing 102 at least through open portions **104*a* of the casing 102. Once disposed at the desired depth, operation 504, the tool 200 is also filled with water W from the wellbore 100**, as depicted in the corresponding left-hand figure.

In operation 506, a working gas G is used to pressurize the outer string 106 of the wellbore 100, so as to expel water W from the outer string 106. In operation 508, working gas G is also used to pressurize the inner string 118 in operation 506, so as to expel water W from both the inner string 118 and the tool 200 disposed therein. In general, operations 506 and 508 are performed substantially simultaneously, while water W continues to fill the space between the casing 102 and outer string 106.

The purpose of operations 506 and 508 is to drive the water from the tool before the gas lift is initiated. Generally, it may be desirable that water W is expelled to a level below that of the string gas passages **118*a* in the wall of the inner string 118. As can be seen in the same left-hand figure, water W is substantially expelled from the tool 200, so as to only be present at the liquid inlet 208** thereof.

The method 500 continues at operation 510, where working gas G pressure on the inner string 118 is reduced. This allows water W, under pressure from the surrounding water table, to enter the tool 200 and flow up the inner conduit 212 thereof. Additionally, the working gas G flows from the outer string 106, through the string gas passages **118*a* and into the inner string 118. The working gas G continues to flow upwards within the inner string 118 and then into the tool 200 via the tool gas passages 220. In an alternative embodiment, the working gas G pressure within the inner string 118 may be maintained and the working gas G pressure in the outer string 106 may be increased to as to have the same effect. The interaction of the upwardly-flowing working gas G and water W in the interior chamber 204 produces a mist M that is expelled from the tool 200** and collected at the surface. Here, the water may be separated from the mist M.

This circulation of working gas G continues. In operation 512, a flow rate of the water W entering the tool 200 or leaving the well may be monitored during the injection of the working gas G. This flow rate may be used as a basis to adjust the working gas circulation flow rate or adjust a differential pressure between the outer string 106 pressure and the inner string 118 pressure, as in operation 514. As this injection of working gas G continues, mist M continues to be produced, which removes water W from the wellbore 100, such that the level of water W outside the casing 102 drops below the level of the open portion **104*a* thereof, as depicted in the left-hand figure accompanying operations 512 and 514. In certain embodiments, the working gas G flow may be balanced against the water W flow so as to remove substantially all or all of the water W from the tool 200 as a mist M. Once the pressure on a nearby coal bed is reduced due to the removal of water W from the wellbore 100 as a mist M, methane gas product P is extracted, passively or actively, via the space between the casing 102 and the outer string 106, as depicted in operation 516** and the accompanying left-hand figure.

Injection rates for the working gas G may be determined by the Coleman method "Critical Flow for Water Removal". Based on wellhead pressures ranges from 5 to 50 psig, the required injection rates would range from 50 to 100 MCFD (thousand standard cubic feet/day, sometimes also shown as MSCFD) in order to lift water from the inner tubing string. The Coleman method "Critical Flow for Water Removal" is:

$$v_c(\text{water}) = \frac{4.43(67 - 0.0031p)^{0.25}}{(0.0031p)^{0.5}}$$

Additionally, $$q_c(Mscf/D) = \frac{3060pv_cA}{Tz}$$

In the above equations:

$T_{tf}$=Flowing tubing temperature, ° R $q_c$=Critical flow rate, MCFD p=Wellhead pressure, psi $v_c$=Critical velocity of water, ft/sec A=Cross sectional area, $ft^2$ Z=Compressibility factor A pressure/head differential from the wellbore/casing into the inner string is utilized so that the water W flows into the tool. The injected working gas G can carry the mist M to the surface. If the combined back pressure/head in the inner string is greater than the head pressure at the equivalent depth in the casing, no fluid will enter the tool, as depicted in the equation below:

$$(P_w)>(P_t)$$

Where the inner string combined pressure at the tool ($P_t$) =Surface Pressure+Working Gas Head+Water Head+Friction. The wellbore combined pressure ($P_w$)=Surface Pressure+Working Gas Head+Water Head+Friction. For ease of application, certain assumptions may be made. For example, the Surface Pressure is assumed to be the same for both $P_t$ and $P_w$. Additionally, the Working Gas Head is considered to be negligible (e.g., less than 5 psig). Friction in the casing is also assumed to be negligible, given the large diameter of the casing.

Thus, for $P_w$ to be greater than $P_t$, Water Head in the wellbore must be greater than the Water Head in the inner string plus Friction in the inner string. In an embodiment, a ⅛" choke is placed below the tool to regulate water flow into the inner string and keep the water head to a manageable level in the inner string (e.g., 0.25 to 3 GPM calculated). With typical tubing/inner string depth of 3000 ft., it takes less than about 2 minutes to clear the inner string of water. Additionally, the greater the working gas injection rate, the faster the inner string is cleared of water and the greater the reduction in water volume/head. An increase in working gas injection rate, however, increases friction. Conversely, when the working gas injection rate is lowered, the friction falls. This reduction in working gas injection rate, however, increases water head and allows more water to enter the inner string.

In one embodiment, a starting point for working gas injection is about 100 MCFD and it normally takes up to 30 minutes or more before mist M is seen at the surface. Water rates in the mist M range from 1 to 8 barrel of water per day (which indicates that the differential pressure of the wellbore to inner string is less than 1 psi). Wellbores utilizing the tools described herein may require 20 to 60 psig injection pressure at 100 MCFD injection rate with approximately 5 psig at the surface. In certain embodiments, inner string depths of about 1000 ft. are injected at about 20 psig, while inner string depths greater than 3500 ft. may require about 60 psig injection pressure. In other embodiments, wellbores may require more pressure, e.g., approximately 100 psig to inject 100 MCFD, depending on the configuration of the tool utilized. Because most of the pressure drop happens across the nozzle, the depth of inner string does not affect the injection pressure as much as the tool.

This disclosure described some embodiments of the present technology with reference to the accompanying drawings, in which only some of the possible embodiments were shown. Other aspects may, however, be embodied in many different forms and should not be construed as limited to the embodiments set forth herein. Rather, these embodiments were provided so that this disclosure was thorough and complete and fully conveyed the scope of the possible embodiments to those skilled in the art.

Although specific embodiments were described herein, the scope of the technology is not limited to those specific embodiments. One skilled in the art will recognize other embodiments or improvements that are within the scope and spirit of the present technology. Therefore, the specific structure, acts, or media are disclosed only as illustrative embodiments. The scope of the technology is defined by the following claims and any equivalents therein.

What is claimed is:

1. An apparatus comprising:

an elongate body comprising an outer wall, wherein the outer wall defines an interior chamber having an axis and a gas passage in communication with the interior chamber, the elongate body further comprising a base defining a liquid opening and a cap defining an outlet opening adapted to expel a mist from the interior chamber, wherein the liquid opening is adapted to receive a liquid disposed in a wellbore, and wherein the gas passage is adapted to receive a gas, wherein the gas passage is disposed a first distance from the base;

an inner conduit disposed in the interior chamber, and wherein the inner conduit comprises:

a first open end having a first open end diameter and in communication with the liquid opening; and a second open end having a second open end diameter and in communication with the interior chamber, wherein the second open end is disposed a second distance from the base, wherein the gas passage is disposed at a location along the axis between the first open end and the second open end, and wherein the second open end of the inner conduit is adapted to expel the liquid into the interior chamber; and a choke disposed between the liquid opening and the first open end, wherein the choke has a choke diameter less than the first open end diameter of the inner conduit and the second open end diameter of the inner conduit and the interior chamber.

2. The apparatus of claim 1, wherein the cap comprises a retrieval neck.

3. The apparatus of claim 1, further comprising two bore supports substantially surrounding the elongate body.

4. The apparatus of claim 1, wherein the liquid opening comprises the choke.

5. The apparatus of claim 1, wherein the second open end is disposed proximate the choke.

6. The apparatus of claim 1, further comprising at least one sensor for detecting at least one of a liquid pressure, a gas pressure, a mist pressure, a liquid flow rate, a gas flow rate, and a mist flow rate.

7. The apparatus of claim 1, wherein the first distance is less than the second distance.

8. The apparatus of claim 1, wherein the inner conduit comprises a plurality of inner conduits arranged about a circumference of the elongate body, and wherein the gas passage is disposed substantially axially within the elongate body.

9. An apparatus comprising:

an elongate body defining an interior chamber, a body liquid inlet, a gas inlet in communication with the interior chamber, and a liquid-gas outlet in communication with the interior chamber, wherein the liquid-gas outlet is adapted to expel a mist from the interior chamber;

an inner conduit disposed within the interior chamber of the elongate body and in communication with the body liquid inlet, wherein the inner conduit defines a conduit liquid inlet and a liquid outlet in communication with the interior chamber, wherein the liquid outlet is adapted to expel a liquid into the interior chamber, and wherein the gas inlet is disposed a first distance from the body liquid inlet and wherein the liquid outlet is disposed a second distance from the body liquid inlet, wherein the second distance is greater than the first distance, and wherein the gas inlet is disposed between the body liquid inlet and the liquid outlet; and a choke disposed between the body liquid inlet and the conduit liquid inlet.

10. The apparatus of claim 9, further comprising a connection element disposed proximate the liquid-gas outlet.

11. The apparatus of claim 9, wherein the choke is disposed proximate the conduit liquid inlet.

12. The apparatus of claim 9, wherein the inner conduit is axially disposed within the elongate body.

13. The apparatus of claim 9, wherein the elongate body comprises an outer wall, wherein the outer wall defines the gas inlet.

14. The apparatus of claim 9, wherein the elongate body comprises a manifold, wherein the manifold defines the conduit liquid inlet and the gas inlet.

15. An apparatus comprising:

an elongate body comprising an outer wall, wherein the outer wall defines an interior chamber having an axis and a gas passage in communication with the interior chamber, the elongate body further comprising a base defining a liquid opening and a cap defining an outlet opening, wherein the liquid opening is adapted to receive a liquid disposed in a wellbore, and wherein the gas passage is adapted to receive a gas, wherein the gas passage is disposed a first distance from the base;

two bore supports substantially surrounding the elongate body;

an inner conduit disposed in the interior chamber, and wherein the inner conduit comprises:

a first open end having a first open end diameter and in communication with the liquid opening; and a second open end having a second open end diameter and in communication with the interior chamber, wherein the second open end is disposed a second distance from the base, wherein the gas passage is disposed at a location along the axis between the first open end and the second open end; and a choke disposed between the liquid opening and the first open end, wherein the choke has a choke diameter less than the first open end diameter of the inner conduit and the second open end diameter of the inner conduit and the interior chamber.

16. The apparatus of claim 15, wherein the second open end of the inner conduit is adapted to expel the liquid into the interior chamber, and wherein the outlet opening is adapted to expel a mist from the interior chamber.

17. The apparatus of claim 15, wherein the cap comprises a retrieval neck.

18. The apparatus of claim 15, wherein the liquid opening comprises the choke.

19. The apparatus of claim 15, wherein the second open end is disposed proximate the choke.

20. The apparatus of claim 15, wherein the first distance is less than the second distance.

21. The apparatus of claim 15, wherein the inner conduit comprises a plurality of inner conduits arranged about a circumference of the elongate body, and wherein the gas passage is disposed substantially axially within the elongate body.

22. The apparatus of claim 15, further comprising a connection element disposed proximate the outlet opening.

* * * * *